US005246124A

United States Patent [19]

Battegazzore

[11] Patent Number: 5,246,124

[45] Date of Patent: Sep. 21, 1993

[54] CLOSURE DEVICE FOR BOTTLES, PARTICULARLY INTENDED FOR BOTTLES CONTAINING QUALITY DRINKS

[75] Inventor: Piero Battegazzore, Alessandria, Italy

[73] Assignee: Guala S.p.A., Alessandria, Italy

[21] Appl. No.: 840,442

[22] Filed: Feb. 21, 1992

[30] Foreign Application Priority Data

Mar. 5, 1991 [IT] Italy ..... MI 91 A 000565

[51] Int. Cl.[5] ..... B65D 41/32

[52] U.S. Cl. ..... 215/251; 215/254; 215/274; 215/230; 220/270; 222/567; 222/570

[58] Field of Search ..... 215/254, 253, 251, 250, 215/249, 274, 256, 258, 230, 203, 201; 220/270; 206/45.33; 222/567, 570

[56] References Cited

U.S. PATENT DOCUMENTS

| | | | |
|---|---|---|---|
| 2,201,791 | 5/1940 | Samburg | 215/230 |
| 2,218,040 | 10/1940 | Hutaff, Jr. | 215/254 |
| 3,332,564 | 7/1967 | Meierhoefer | 215/274 X |
| 3,511,402 | 5/1970 | Cheeley | 215/254 |
| 3,920,141 | 11/1975 | Bojardi | 215/253 X |
| 4,595,123 | 6/1986 | Libit | 215/203 X |
| 5,121,852 | 6/1992 | Wilkes | 220/320 X |

*Primary Examiner*—Gary E. Elkins
*Assistant Examiner*—Paul A. Schwarz
*Attorney, Agent, or Firm*—Notaro & Michalos

[57] ABSTRACT

In a closure device for bottles, particularly intended for bottles containing quality drinks, there are provided a pour body adapted to be secured on the neck of the bottle and a cap which engages releasably with the pour body; the cap is rigid with a tubular outer skirt which abuts against an annular outer portion of a collar fast with the pour body; the skirt and the annular outer portion are bonded by a frangible outer ring which provides a seal hard to rebuild at a low cost.

16 Claims, 3 Drawing Sheets

37a
68
OPENED
41a
27a
25a
66

37a
54a
48a
49a
67
42a
52a
63
47a
62
64
VI
VI
61
64
27a
25a
68
41a
66
65
42a
52a
60

37a
25a
54a
41a
52a
42a
27a
66
65

CLOSURE DEVICE FOR BOTTLES, PARTICULARLY INTENDED FOR BOTTLES CONTAINING QUALITY DRINKS

FIELD AND BACKGROUND OF THE INVENTION

This invention relates to a closure device for bottles, particularly intended for use on bottles containing quality drinks such as vintage spirits.

Known are closure devices for bottles which comprise essentially a pour body adapted for secure mounting to the bottle neck and a cap which is releasably engaged with the pour body; the cap is rigid with a tubular outer skirt abutting an annular outer portion of a collar attached to the pour body.

The tubular outer skirt and the annular outer portion abutting the skirt afford a closure device having exposed surfaces which are free of faults or distortions and can accept appropriate decoration.

Such closure devices also comprise sealing means simply provided by a wax applied over a step formed in a juncture between the skirt and the annular outer portion of the collar.

A fault inherent to that sealing arrangement is that it can be readily rebuilt at a low cost by reason of its very simplicity.

This may easily invite tampering as enacted by picking up an emptied bottle complete with its, unsealed, closure device and re-filling it with some similar, but inferior quality drink, thereafter the bottle would be re-applied its closure device and the seal rebuilt.

SUMMARY OF THE INVENTION

It is the object of this invention to provide a bottle closure device which can remedy the above fault.

This object is achieved by a closure device for bottles, particularly intended for use on bottles containing quality drinks, which comprises a pour body adapted for secure mounting to the bottle neck, and a cap being releasably engaged with the pour body and rigid with a tubular outer skirt abutting an annular outer portion of a collar rigid with said pour body, said skirt and said annular outer portion being interconnected by a sealing means, characterized in that said sealing means comprises a frangible outer ring binding said skirt and said annular outer portion of the collar together.

BRIEF DESCRIPTION OF THE DRAWINGS

In the interest of a clearer understanding of the features and advantages of this invention, a description will be given herein below of two non-limitative embodiments thereof, illustrated by the accompanying drawings, wherein.

DESCRIPTION OF THE PREFERRED EMBODIMENT

Figure 1:
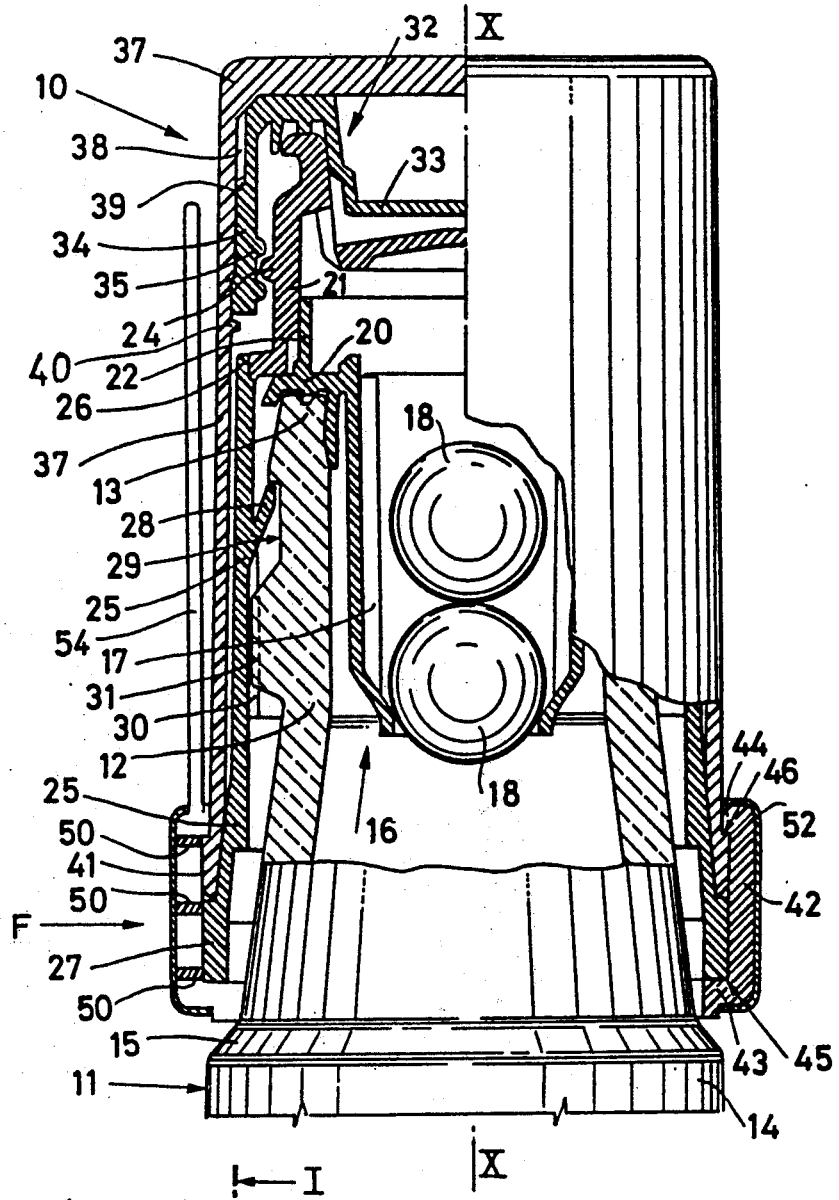
FIG. 1 is a part-sectional elevation view, taken along line I—I in FIG. 2, of a closure device for bottles according to the invention.

With reference to FIG. 1, the closure device of this invention is indicated at 10 and the bottle, of which only the top portion is shown, is indicated at 11.

The bottle 11 is conventional and has a longitudinal axis X—X, a substantially cylindrical neck 12 with a mouth 13, and a bottle body 14 merging externally into the neck 12 through an annular portion 15 lying at an angle to the axis X—X.

The closure device 10 includes preferably a valve assembly adapted to prevent deceptive filling of the bottle 11. Said valve assembly comprises a tubular member 16 made of an elastically deformable material, being an interlocked fit in the mouth 13 and formed of a portion 17, received in the neck 12 to retain two glass balls 18 in a guided fashion along the axis X—X, and of a flange 20 abutting the mouth 13.

A pour body 21 is a force fit over an extension 22 of the tubular member 16. A threadway 24 is formed circumferentially around the pour body 21.

The closure device 10 further comprises a collar 25 of a suitably rigid synthetic plastics material, such as an ABS resin; this collar 25 has a substantially cylindrical shape and fits over the neck 12 of the bottle 11 and is attached, such as by ultrasonic welding, with a top end 26 to the pour body 21.

Formed circumferentially around an opposite bottom end of the collar 25 located next to the angled portion 15 of the bottle 11, is a raised annular portion 27.

Formed internally of the collar 25 are tabs 28 sloping inwards and toward the top end 26 of the collar 25 in abutting engagement inside a recess 29 formed in the neck 12 of the bottle 11. In addition, the interior of the collar 25 and the neck 12 are formed with mutually engaged, respective longitudinal ribs 30 and 31.

The closure device 10 further comprises a cap 32 mounted on the pour body 21; defined in the cap 32 are a bottom 33 and a tubular wall 34 which is formed with an inside threadway 35 engaging with a threadway 24 on the pour body 21. The cap 32 blocks the pour body 21 in a tight sealed manner.

Rigid with the cap 32 is a smooth tubular skirt 37 having a strictly constant thickness and extending coaxially with the cap 32.

The skirt 37 has annular elevations 40 thereon effective to retain the cap 32. Furthermore, respective longitudinal ribs 38, 39 are formed on the cap 32 exterior and the skirt 37 interior for mutual engagement.

The skirt 37 is formed from a suitable stiff synthetic plastics material such as an ABS resin.

The bottom end of the skirt 37 has a raised annular portion 41 which abuts against the raised annular portion 27 on the collar 25, thereby this annular portion 27 forms an extension of the skirt 37.

The above two outer and raised annular portions 27 and 41 are interconnected by a sealing means.

Such sealing means includes an outer ring 42 which binds the two raised annular portions 27 and 41. In particular, the ring has a substantially C-shaped cross-section with opposed sides 43 and 44 which engage oppositely located steps 45 and 46 formed by the annular portions 27 and 41, respectively.

The ring 42 is made frangible, and to this aim, it includes an arcuate tear-off portion 47 (FIG. 2) which is connected to the remainder of ring 42 through two weakening sections 48, 49 on opposite sides of said tear-off portion 47. Within the weakening section 48, the tear-off portion 47 is arranged to connect to the remainder of ring 42 through just a series of bridges 50 which span the full height of the ring. It is contemplated that, within the weakening section 49, the tear-off portion 47 be connected to the remainder of ring 42 by bridges 51 which extend approximately half-way up the ring 42, the tear-off portion being made integral with the remainder of the ring over the other half of the ring height.

A tab 54 extends, close to the skirt 37, upwardly from the tear-off portion 47.

The ring 42 may be molded from a plastics material, such as polypropylene.

The sealing means also comprises a thin outer band 52 fitting around said ring 42 in close contact therewith.

Preferably, said band 52 is of a metallic material, such as aluminum, and is set tightly around the ring 42 by a magnetic forming process. The magnetic forming process is carried out by generating a quickly varying, high-energy magnetic field, e.g. by the supply of a high-current pulse through suitable leads arranged to induce a current through the band; the energy transferred to the band by interaction between the induced current and the magnetic field is of such a level as to create a force which causes the band to shrink radially and set tightly around the outer surface of the ring 42.

The outer band 52 has a substantially C-shaped cross-section, the same as ring 42.

Figure 2:
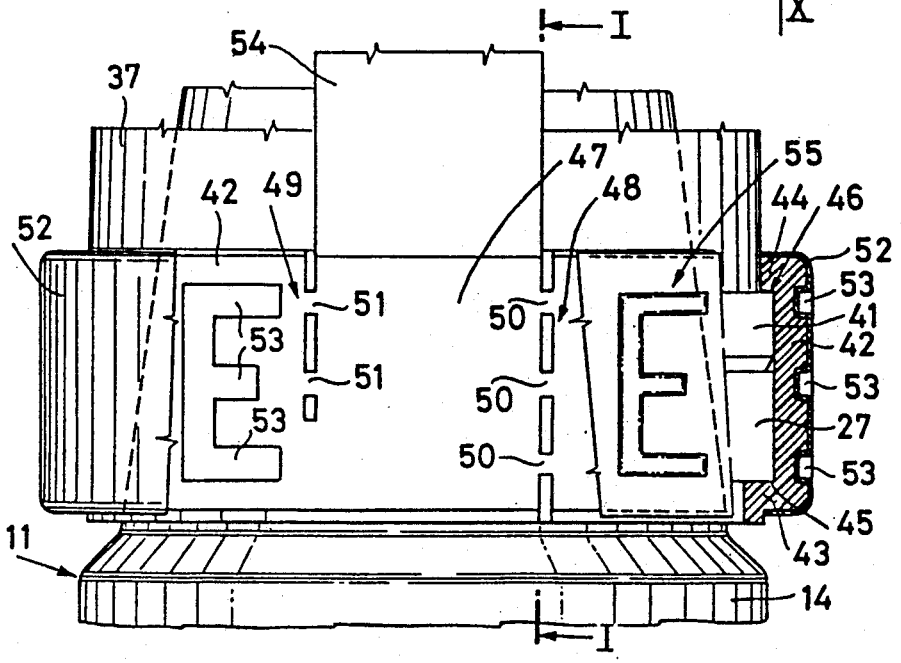
FIG. 2 is a cutaway detail view, in the direction of arrow F, of the closure device in FIG. 1.

Preferably, the ring 42 is formed with depressions into which the band 52 is inset. These depressions may be in the form of letters, as shown in FIG. 2, where the letter "E" is illustrated by way of example and the depressions are denoted by 53 (the depressions viewed in cross-section on the right relate to the horizontal bars of the "E"). The band 52 will therefore show recessed E-shaped patterns 55. The letters may spell, for example, a trademark of the bottle contents and/or a brand name. Of course, graphics of any kinds could be alternatively shown, such as characters, numerals, logos, etc.

The closure device 10 is assembled by welding the collar 25 to the pour body 21, screwing the cap 32 onto the pour body 21, force fitting the pour body 21 over the extension 22 of the tubular member 16, introducing balls 18 into the tubular member 16, force fitting the skirt 37 over the cap 32, and finally force fitting the ring 42 over said raised annular portions 27 and 41 around which the band 52 would be subsequently set.

The closure device 10 thus assembled is installed on the bottle 11 by driving the tubular member 16 into the neck 12 of bottle 11 so as to have it interlocked at the location of the mouth 13.

The collar 25 is firmly retained axially on the neck 12 by the abutting engagement of the tabs 28 in the recess 29; also, the collar 25 is prevented from turning by the interfit relationship of the longitudinal ribs 30 and 31, respectively on the collar 25 and the neck 12.

The cap 32 is retained axially to the skirt 37 by the annular elevations 40; further, relative rotation of the skirt 37 and the cap 32 is inhibited by the interfitting longitudinal ribs 39 and 38.

The closure device 10 is particularly useful with bottles intended to contain quality drinks, such as vintage spirits, by virtue, inter alia, of the skirt 37 presenting a broad, smooth and faultless outer surface of aesthetic value and ideally suited to accept decoration.

Figure 3:
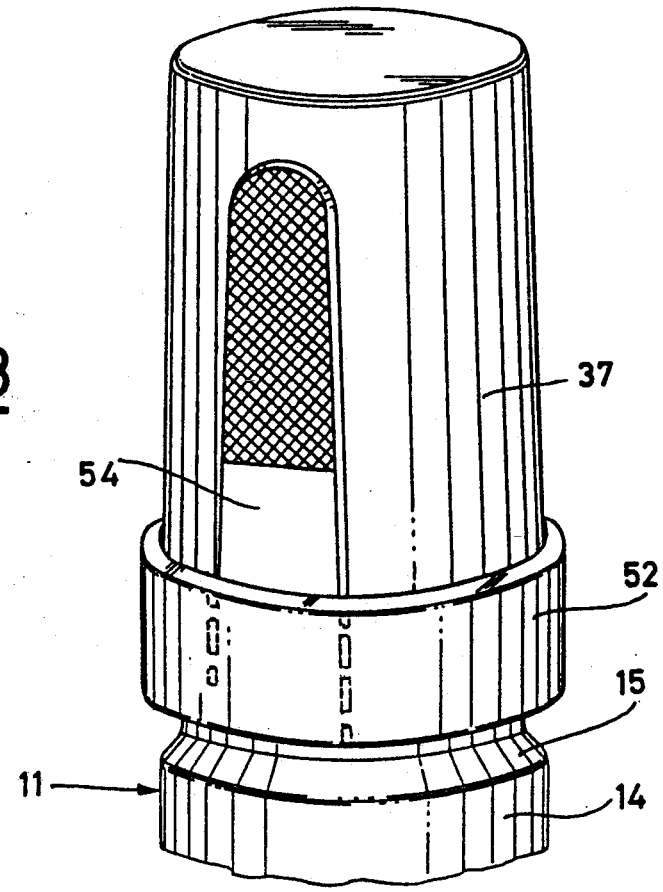
•FIGS. 3 and 4 are perspective views illustrating how the closure device of FIG. 1 is unsealed.
Figure 4:
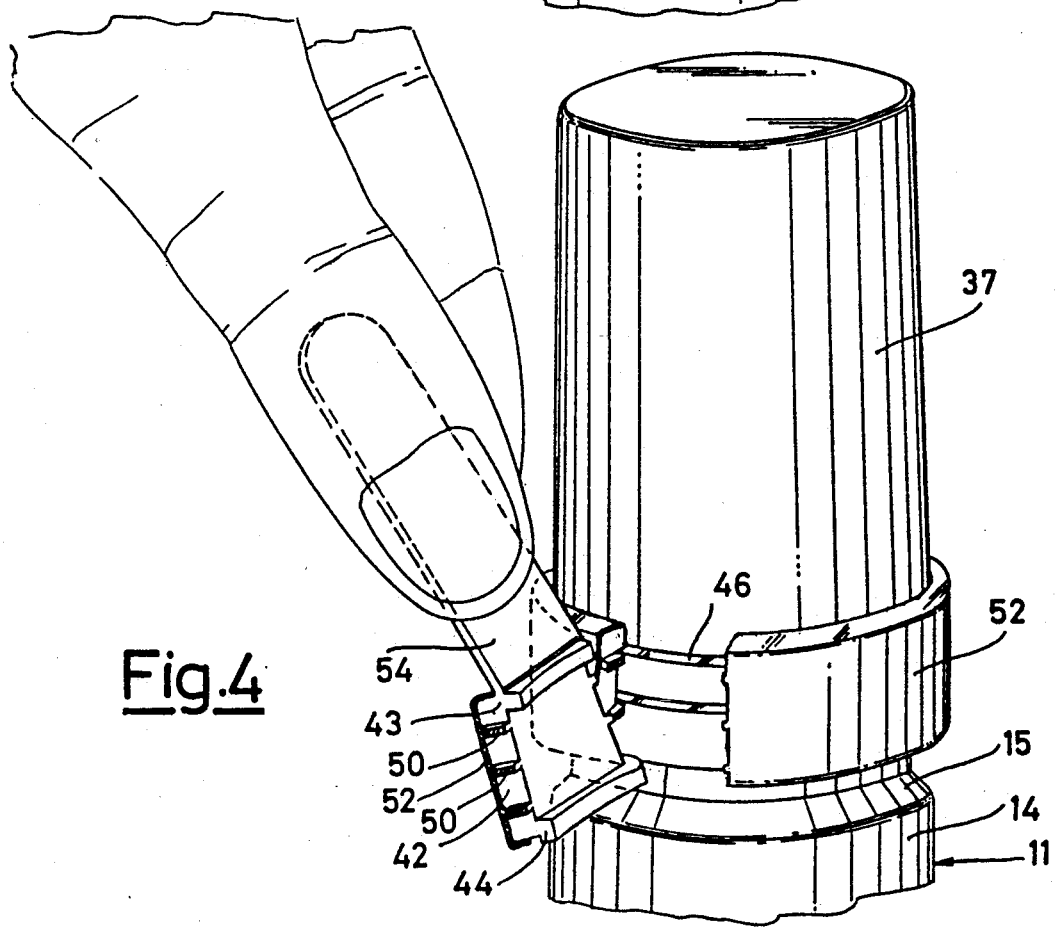

In order to unseal the closure device 10, one proceeds as shown in FIGS. 3, 4 (for clarity, the E-shaped recessed pattern is not shown in these Figures). In essence, one grasps the tab 54 to apply an outwardly directed pull from the bottle 11, thereby rupturing the bridges 50 and 51 and opening the ring 42. Continued pulling of the tab 54 in a clockwise direction about the bottle 11 causes the ring 42 to come loose from the raised annular portions 27 and 41. Together with ring 42, the band 52 is also ruptured along sections 48, 49.

The ring 42 already provides by itself a tamper-proof seal which is difficult to restore once broken because it would display the rupture opened condition. Of course, it could be replaced with a new ring, but this would entail high costs of production and assembly of the ring to the closure device, apt to discourage any tampering attempt.

Accordingly, the ring 42 already provides a solution to the problem mentioned in the preamble.

The provision of the band 52 increases the difficulty of rebuilding the sealing arrangement, as it would also display a rupture opened condition.

In addition, the band, being of metal construction in this embodiment, becomes so distorted as to be hardly restorable after unsealing to its original C-shaped cross-sectional configuration.

The application of a new band would be again cost-intensive due to the requirement for magnetic forming.

Also, the provision of depressions and corresponding recessed patterns in the forms of letters, respectively in the ring 42 and the band 52, makes for added difficulty of rebuilding the sealing arrangement because it introduces more elements that come to harm on unsealing and require re-making.

It should be added that the removal of the ring 42 and the band 52 in no way deteriorates the underlying raised annular portions 27 and 41, so that the closure device will loose nothing of its aesthetic appeal. Accordingly, such annular portions 27 and 41 may be made to carry graphics of various descriptions, e.g. the graphics displayed on the band 52 could be duplicated thereon.

Variations may be applied to the configurations of the ring, the band, and the underlying raised annular portions.

The materials employed in the construction of this closure device may be others than those described hereinabove.

The band could be clamped around the ring using a forming process other than magnetic.

The ring could be provided with elevations, instead of depressions, to be encompassed by the band, thereby the latter would show outward deformations in correspond patterns to the elevations. Such elevations could also be in the forms of generic graphic markings.

The tab may be given a shape and layout other than that shown.

Figures 5, 6, 7:
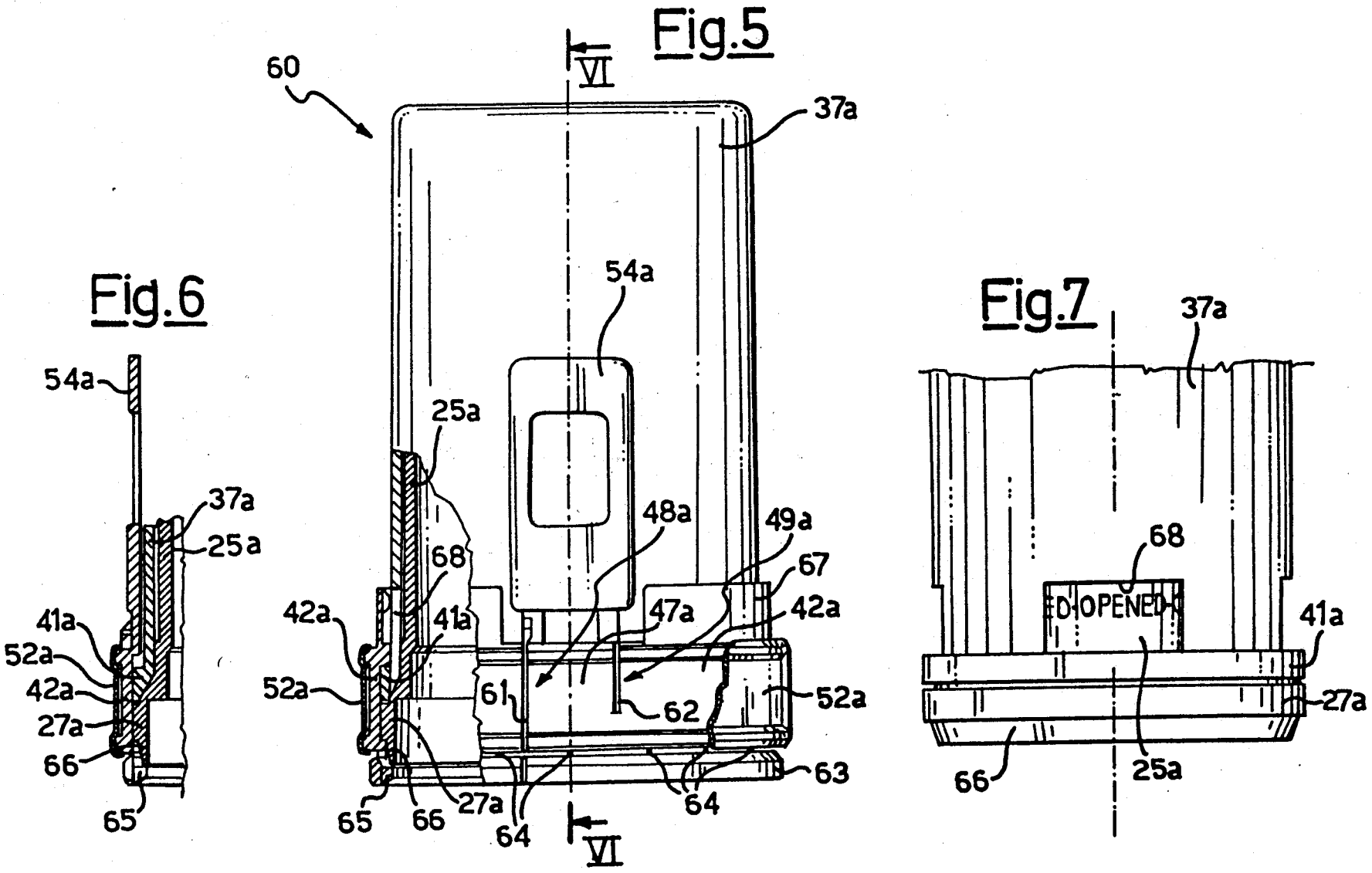
FIG. 5 is a part-sectional elevation view of a closure device similar to that shown in FIG. 1, but supplemented with additional tamper-proof elements.
FIG. 6 shows a fragmentary section taken along line VI—VI in FIG. 5.
FIG. 7 shows the closure device of FIG. 5 in the unsealed condition thereof.

The closure device of FIGS. 5, 6, 7, generally indicated at 60, is similar to the above-discussed closure device 10, but provided with additional tamper-proofing elements.

Similar component parts of closure device 60 to those of closure device 10 are denoted by the same numerals with an "a" suffix. It should be noted that the weakening sections **48*a* and 49*a* are obtained here by means of cutouts 61 and 62, respectively, formed in the ring 42*a*, cutout 62 being arranged to span the full height of the ring 42*a*, and cutout 62 approximately one half only of ring 42*a*** height.

Additionally to what has been illustrated for closure device 10, closure device 60 includes a bottom ring 63 coaxial with ring 42*a* and connected thereto by a series of bridges 64. The ring 63 has inward elevations 65 adapted to mate with a recessed rim 66 on the raised annular portion 27*a* of the collar 25*a*.

Further in addition to what has been illustrated for closure device 10, provided in closure device 60 is an annular wall 67 which extends integrally from the ring 42*a* and covers a series of windows 68 formed annularly in the skirt 37*a*. This annular wall 67 is only discontinued at the tab 54*a*, which takes over at the discontinued section in the function of covering, at least in part, the window 68 behind it. The annular band of the collar 25*a* located at the windows 68 is applied an indication of the closure device 60 having been unsealed, such as the inscription OPENED shown in FIG. 7; of course, any equivalent graphic symbols may be used to provide visual indication of the unsealed condition.

Closure device 60 is unsealed in a similar way to closure device 10, that is the tab 54*a* is first grasped and pulled away from the bottle, and then pulled circumferentially in a counterclockwise direction. This operation results in the ring 42*a* and band 52*a* being first ruptured and unwound, similarly to closure device 10. In addition, as the ring 42*a* is being unwound, the bridges 64 are progressively broken until ring 63 fully parts from ring 42*a*; said ring 63 cannot be slid off the closure device because it is held back by its annular elevations 65 abutting against the rim 66 of the portion 27*a* of collar 25*a*. Finally, on removing the ring 42*a*, the wall 67 is also detached and the windows 68 are uncovered.

The same advantages as previously mentioned with reference to closure device 10 are also afforded by ring 42*a* and band 52*a* toward tamperproofing.

The tamperproof feature is enhanced by the ring 63, once separated from ring 42*a*, staying fixedly with the closure device 60 and forcing, in the event of a deceptive re-construction of the closure device seal, restoration of all the connection bridges to the top ring. It should be added that, upon removal of ring 42*a*, progressive rupturing of the bridges 64 generates a sound effect to reveal that the seal is being broken; the retention of ring 63 after the closure device 60 is unsealed will then display the unsealed condition of the latter.

Tampering with the closure is further resisted by the annular wall 67 constituting yet another element that requires to be rebuilt before the closure can be re-sealed. Also, once the ring 42*a* is removed together with the wall 67 from the closure device 60, the windows 68 become uncovered, as shown in FIG. 7, and the indications of the closure device having been unsealed fully exposed therethrough to provide evidence of the tampering act.

As for ring 63, at the location of the cutout 61, there could be alternatively provided a strong bridge for connecting ring 63 to ring 42*a*, and a weakening section of ring 63 whereby ring 63 will also be ruptured on completion of the ring 42*a* removal and come away together with ring 42*a*. In this way, the advantage would be secured of eliminating ring 63 from the closure device, which ring may be aesthetically unattractive, but at the expense of losing the visual evidence of the closure device having been unsealed. Alternatively to the bridges 64, a continuous weakened connector portion may be provided, although in this case the sound effect would be lost upon unsealing.

For the purpose of simplification, the embodiment of FIG. 5 could do without the ring 63 or, alternatively, the wall 67, windows 68, and related graphical indications on collar 25*a*.

Of course, the ring 42*a* could be provided or not with depressions or elevations in graphic forms penetrated or encompassed by the band 52*a*, either using a magnetic forming process or otherwise.

I claim:

1. A closure device for a bottle having a bottleneck, particularly for bottles containing quality drinks, comprising a pour body adapted for secure mounting to the bottle neck, a cap releasably engaged to the pour body, a tubular outer skirt fixed to the cap, a collar rigidly connected to said pour body and having an annular outer portion, said skirt abutting said annular outer portion and being interconnected with said annular outer portion by a sealing means, said sealing means comprising a frangible outer ring binding said skirt and said annular outer portion of the collar together, and an outer band fitted around said ring and in close contact with said ring.

2. A closure device for bottles according to claim 1, wherein said ring has a substantially C-shaped cross-section with opposite sides, the skirt having opposite steps formed respectively by a raised annular portion on the skirt, the opposite sides of the ring engaging the opposite steps and said annular portion on the collar.

3. A closure device for bottles according to claim 1, wherein said ring includes a tear-off portion connected to the remainder of the ring through weakening sections of the ring, with a tab extending from said tear-off portion.

4. A closure device for bottles according to claim 2, wherein said tear-off portion is an arcuate portion of the ring connected on opposite sides to the remainder of the ring through bridges along at least a part of a height of the ring.

5. A closure device for bottles according to claim 4, wherein the bridges extend on one side of the arcuate portion along the entire height of the ring and on the opposite side of the arcuate portion along about one half the ring height.

6. A closure device for bottles according to claim 1, wherein said band is fitted into a C-shaped configuration around the ring.

7. A closure device for bottles according to claim 1, wherein said band is made of a metallic material and set tightly around the ring by a magnetic forming process.

8. A closure device for bottles according to claim 1, wherein said ring is formed with depressions which are penetrated by said band, thereby the band takes inward deformations correspondingly with the pattern of the depressions.

9. A closure device for bottles according to claim 8, wherein said depressions are in the pattern of generic graphics.

10. A closure device for bottles according to claim 1, wherein said ring is formed with elevations encompassed by said band, thereby the band takes outward deformations correspondingly with the pattern of the elevations.

11. A closure device for bottles according to claim 10, wherein said elevations are in the pattern of generic graphics.

12. A closure device for bottles according to claim 1, wherein a further ring is rupture connected to the ring binding the skirt and the annular outer portion of the collar, said further ring being retained axially on the collar by abutting engagement with a rim of the collar.

13. A closure device for bottles according to claim 12, wherein the rupture connection between said further ring and the binding ring comprises bridges.

14. A closure device for bottles according to claim 1, wherein from the ring binding the skirt and the annular outer portion of the collar there extends an annular wall having a series of windows formed behind it in said skirt, with graphic indications of that the closure device has been unsealed being applied to the annular band of said collar located in the area of said windows.

15. A closure device for bottles according to claim 12, wherein from the ring binding the skirt and the annular outer portion of the collar there extends an annular wall having a series of windows formed behind it in said skirt, with graphic indications of that the closure device has been unsealed being applied to the annular band of said collar located in the area of said windows.

16. A closure device for bottles according to claim 3, wherein the tear-off portion is an arcuate portion of the ring connected to the remainder of the ring on the one side through a cutout which extends along the entire height of the ring, and on the opposite side, through a cutout which extends along about one half of the ring height.

* * * * *